US005465556A

United States Patent [19]

Wooldridge et al.

[11] Patent Number: 5,465,556

[45] Date of Patent: Nov. 14, 1995

[54] CONTAINER PROVIDING SELECTIVE ACCESS TO STORED OBJECTS

[75] Inventors: Sammy E. Wooldridge, Alta Loma; Jay F. Yoakum; Hannis L. Stoddard, III, both of Norco, all of Calif.

[73] Assignee: Avid Marketing, Inc., Norco, Calif.

[21] Appl. No.: 100,931

[22] Filed: Aug. 2, 1993

[51] Int. Cl.[6] ..... B65B 5/10; B65B 43/38

[52] U.S. Cl. ..... 53/468; 53/467; 53/473; 53/475; 53/492; 206/210; 206/438

[58] Field of Search ..... 206/363, 368, 206/369, 379, 438, 443, 210; 53/50, 246, 467, 468, 473, 475, 492

[56] References Cited

U.S. PATENT DOCUMENTS

| | | | |
|---|---|---|---|
| 1,437,596 | 12/1922 | Korb | 206/369 |
| 2,148,721 | 2/1939 | Avstreih | 206/369 |
| 3,080,033 | 3/1963 | Scott et al. | 53/246 X |
| 3,451,133 | 6/1969 | Hathaway et al. | 206/369 X |
| 5,150,788 | 9/1992 | Weissman | 206/369 |
| 5,307,933 | 5/1994 | Guignet et al. | 206/443 |

*Primary Examiner*—Linda Johnson
*Attorney, Agent, or Firm*—Robert E. Malm

[57] ABSTRACT

A container providing selective access to stored objects consists of a plurality of cells for storing objects and a mechanism for causing the cells to open and close in accordance with a control pattern that specifies the cells that are to be opened and the cells that are to be closed. A user, by selecting an appropriate control pattern gains access to those cells in which he has an immediate interest. The user may quickly gain access to other combinations of cells simply by selecting other control patterns.

21 Claims, 2 Drawing Sheets

CONTAINER PROVIDING SELECTIVE ACCESS TO STORED OBJECTS

BACKGROUND OF INVENTION

This invention relates generally to containers having a plurality of cells for the storage of a plurality of objects. More specifically, the invention relates to containers that provide selective access to the cells.

The origin of this invention is a problem that arises in storing, handling, and using identification "tags" that are being used or have the potential of being used for identifying fish, birds, animals, or inanimate objects such as credit cards. Some of the more interesting applications involve objects of small size which means that the tag must be minute. In many cases it is desirable to permanently attach the tag to the object which means implantation of the device in the tissues of living things and somewhere beneath the surfaces of inanimate objects.

The implantation of an identification tag in living tissue is accomplished with a hypodermic syringe-like tool that holds an elongated cylindrically-shaped tag. The implantation tool utilizes a tube with one end cut at a slant and sharpened to form a wedge-shaped end with which to make an incision in the skin and a plunger that enters the tube at the other end and is used to apply a longitudinal force to the tag that rests in the tube just above the wedge-shaped end. The implantation is accomplished by making an incision with the wedge-shaped end and then forcing the tag through the tube in the incision and under the skin by means of the plunger.

At the present time identification tags are supplied to users in bulk containers for immersion in a disinfecting solution. This delivery system requires the user to remove a tag from the container with tweezers, insert the tag into the implantation tool, and finally make the implantation. The process is awkward and time-consuming and provides several opportunities for dropping the tag necessitating a disinfecting step before reuse. The process is particularly cumbersome if the user has a large number of tags to implant at one time.

BRIEF SUMMARY OF INVENTION

The invention is a container having a plurality of cells for storing objects and a means for opening and closing the cells in accordance with a control pattern selected by the user. The opening and closing of the cells takes place upon the selection of the control pattern by the user.

The invention can be realized in many different embodiments. In one purely-mechanical version the invention consists of two solid bodies, one body containing the cells and the other body containing the means for opening and closing the cells. The two bodies are attached to each other in such a way as to permit one body to rotate with respect to the other. The user selects a particular control pattern by rotating one body with respect to the other by a specified angle.

In another purely-mechanical version of the invention the two bodies are attached to each other in such a way as to permit one body to be translated relative to the other. The user selects a particular control pattern by moving one body with respect to the other by a specified distance.

In an electromechanical version of the invention the means for opening and closing the cells are individual hinged covers over the cells. A cover is opened and closed by a spring-loaded solenoid. A cover opens when electrical power is applied to the solenoid which then pulls the cover away from the cell opening by means of a mechanical linkage between solenoid and cover. The cover closes as a result of the spring arrangement when power is removed from the solenoid. The user selects a particular control pattern by entering the decimal number assigned to that control pattern into a decimal-to-binary converter, the binary representation of the decimal number being entered into a register, the number of bits stored in the register being equal to the number of cells. The register bits control the application of power to the solenoids, a one corresponding to power on (cell open) and a zero corresponding to power off (cell closed).

In containers where an object must be removed from a cell by means of a tool, a support means is provided in each cell for holding the object in a position and orientation whereby the object can be acquired and removed from the cell with the tool.

DESCRIPTION OF THE PREFERRED EMBODIMENT

The preferred embodiment of the invention consists of a cell body and a cell access body. The cell body contains the cells for storing objects while the cell access body provides the means for closing and opening the cells when the cell body and the cell access body are fastened together. The cell body and the cell access body are plastic parts that are manufactured by injection molding.

Figure 1:
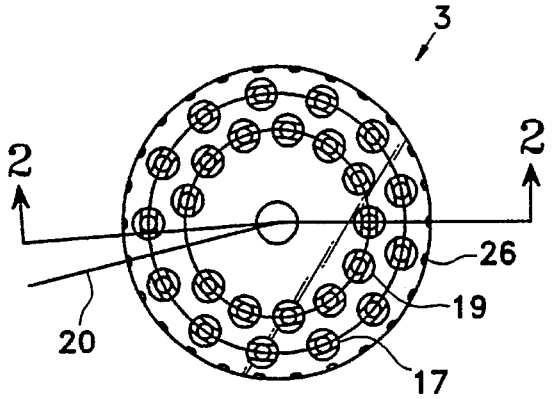
FIG. 1 is the top view of the cell body.
Figure 2:
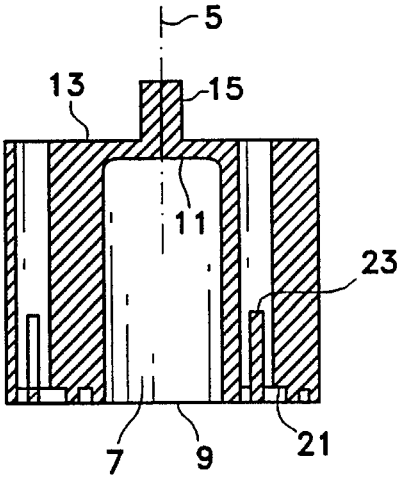
FIG. 2 is a sectional view of the cell body taken upon a plane transverse to the plane of the top view.
Figure 3:
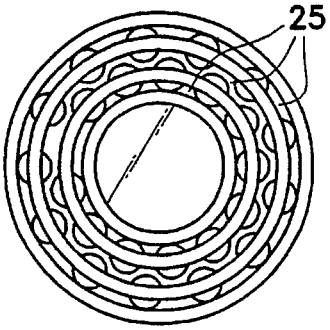
FIG. 3 is the bottom view of the cell body.

A top view of the cell body is shown in FIG. 1, a sectional view is shown in FIG. 2, and a bottom view is shown in FIG. 3. The cell body 3 is cylindrical with an axis of symmetry 5. A cylindrical cavity 7 centered on the axis of symmetry 5 extends from the bottom surface 9 to a surface 11 slightly below the top surface 13. The purpose of cavity 7 is to save material, facilitate injection molding of the part and reduce the cost of the cell body 3.

A cylindrical post 15 having the same axis of symmetry 5 as the cell body 3 extends above the top surface 13 and provides the means for fastening the cell body to the cell access body.

The cells in the preferred embodiment are two concentric rings of cylindrical holes 17, 19 that extend from the top surface 13 to a lower surface 21 slightly above the bottom surface 9. The 13 holes 17 in the outer concentric ring are spaced apart by 360/13 (=~27.69) degrees. The 12 holes 19 in the inner concentric ring are also spaced apart by 360/13 degrees except for the holes on either side of radial 20 and offset by 360/26 (=~13.85) degrees from the holes 17 in the outer concentric ring. The radial 20 denotes the angular position that is 360/13 degrees from adjacent holes on the inner concentric ring but which does not have a hole.

This version of the preferred embodiment is intended to store cylindrical identification tags and to also permit the tags to be extracted from the cells by means of the implantation tool.

For effective extraction of the tag the wedge-shaped end of the tube must enter the cell and descend to a point where the tag is surrounded by the tube. This requirement necessitates the presence of the cylindrical posts 23 that are centered in the holes 17, 19. Tags placed in the holes 17, 19 rest on the posts 23. The distance from the top surface 13 to the tops of the posts 23 is somewhat greater than the length of the tags so that tags stored in the cells are below the top surface 13 and do not interfere with the operation of the cell access body after it is fastened to the cell body.

The shapes and sizes of cells can be tailored to meet the requirements for storing other kinds of objects and using other kinds of tools for the insertion/extraction process. There is no requirement that all of the cells have the same shape and size.

The tags can be shipped to a user in a number of different ways. The preferred way is in a container immersed in a disinfecting solution so that the tags are ready to use when received by the user. Another way is in a kit comprising a tag container loaded with tags, a disinfectant container filled with a disinfecting solution, and a disinfecting container which holds the tag container and the disinfectant container during shipping. With this mode of shipment the user accomplishes the disinfecting process by placing the tag container in the disinfecting container and then emptying the disinfectant container into the disinfecting container.

In order for the disinfecting solution to reach the tags in the tag container, the container must Be permeable to liquids. Consequently, grooves 25 are provided that connect with the holes 17, 19 and permit a liquid (and air) to enter and leave the holes.

Indentations 26 in the circumference of the cell body 3 extending downward a short distance from the top surface 13 and matching protrusions on the cell access body act as detents to maintain the cell body and the cell access body in certain relative positions when assembled. Indentations 26 are located on all radials passing through the centers of holes 17, 19 and also on radial 20.

Figure 4:
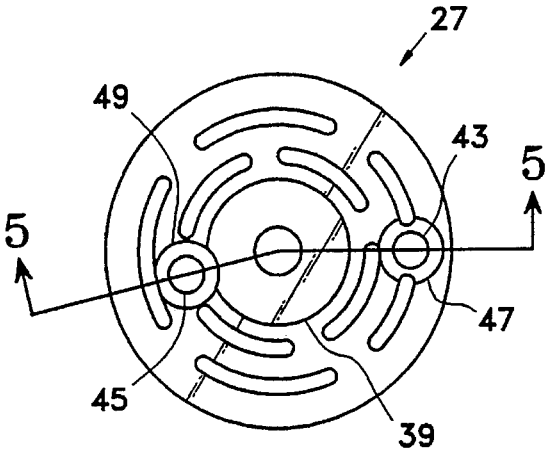
FIG. 4 is the top view of the cell access body.
Figure 5:
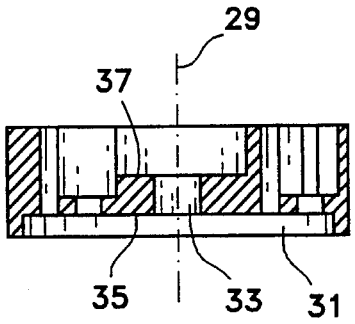
FIG. 5 is a sectional view of the cell access body taken upon a plane transverse to the plane of the top view.
Figure 6:
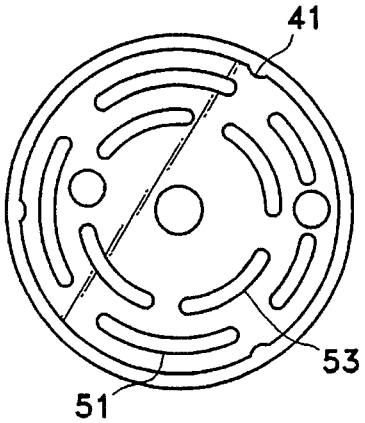
FIG. 6 is the bottom view of the cell access body.

A top view of the cell access body 27 is shown in FIG. 4, a sectional view is shown in FIG. 5, and a bottom view is shown in FIG. 6. The cell access body 27 is cylindrical with an axis of symmetry 29.

The cylindrical recess 31 and the hole 33 provide the means for mating the cell access body 27 with the cell body 3. The assembly of the two parts is accomplished by positioning the cell access body 27 above the cell body 3 and then bringing the two parts together, the post 15 (FIG. 2) passing through the hole 33 (FIG. 5) and surface 13 (FIG. 2) coming in contact with surface 35 (FIG. 5). The two parts are permanently fastened together by applying heat and pressure to the top of the post 15 thereby deforming the portion of the post that extends above the floor 37 of the counterbore 39.

The three equally-spaced protrusions 41 (FIG. 6) in the recess wall of the cell access body 27 mate with three of the indentations 26 (FIG. 1) of the cell body 3 thereby forming a detent mechanism. The 26 depressions 26 on the circumference of the cell body 3 provide 26 detent positions which enable a user to angularly position the cell access body relative to the cell body in 26 easily-sensed positions.

The hole 43 (FIG. 4) in the cell access body 27 has the same radial distance from axis 29 as the outer concentric ring of holes 17 in the cell body 3 (FIG. 1) has from the axis 5. After assembly of the cell body 3 and the cell access body 27, hole 43 in the cell access body provides access to the holes in the outer concentric ring of the cell body.

The hole 45 (FIG. 4) in the cell access body 27 has the same radial distance from axis 29 as the inner concentric ring of holes 19 in the cell body 3 (FIG. 1) has from axis 5. After assembly of the cell body 3 and the cell access body 27, hole 45 provides access to the holes in the inner concentric ring of the cell body.

It should be noted that the detent positions 26 (FIG. 1) correspond to the situations where either hole 43 (FIG. 4) is aligned with a hole 17 (FIG. 1) in the outer concentric ring, hole 45 (FIG. 4) is aligned with a hole 19 (FIG. 1) in the inner concentric ring, or neither hole 43 nor hole 45 is aligned with any of the holes 17, 19 (FIG. 1) in the outer and inner concentric rings (when hole 45 (FIG. 4) is on radial 20 (FIG. 1)). Thus, the cell access body 27 can be positioned at detents which either allow access to any particular cell in the cell body 3 or do not allow access to any cells.

The counterbores 47 and 49 permit easier access to holes 17, 19 (FIG. 1) in the cell body 3 and limit the depth to which the tube of the implantation tool can descend into the holes after assembly of the cell body and the cell access body 27.

After assembly of the cell body 3 and the cell access body 27, the counterbores 47 and 49 (FIG. 4) permit the tube of the implantation tool to descend into a hole 17 or 19 (FIG. 1) in the cell body 3 only to the point where a shoulder on the tube contacts the bottom of the associated counterbore 47 or 49 thereby preventing the tube tip from touching the bottom of the hole.

In retrieving a tag from a cell, the implantation tool is caused to descend to the point where the shoulder of the tube contacts the bottom of a counterbore 47 or 49 thereby preventing the dulling of the tube tip as a result of contacting the bottom of a hole 17 or 19. In this position the tag is above the wedge-shaped end and is surrounded by the tube. The removal of tool and tag is carried out with the container inverted so that the tag cannot fall out of tube at the wedge-shaped end.

The slots 51 (FIG. 6) which are centered on the outer concentric circle of holes 17 (FIG. 1) and slots 53 which are centered on the inner concentric circle of holes 19 (FIG. 1) provide ways for liquids to enter and leave cells through the cell access body 27. The slots are made sufficiently narrow to prevent the objects to be stored in the cells from entering or leaving.

Although the preferred embodiment of the invention is cylindrical, embodiments for other purposes might preferably be rectangular wherein the cells in the cell body are arranged in rows and the cell access body slides rectilinearly with respect to the cell body to provide access to the cells.

The selection of a particular detent by the user and the consequent opening of one particular cell and the closing of all other cells can be characterized more generally as the selection of a control pattern by the user which causes certain cells to be opened and the remaining cells to be closed, the particular combination of open and closed cells being determined by the particular control pattern selected by the user.

In the case of the tag container, each detent corresponds to a control pattern and the selection of a detent (or control pattern) causes either all cells to be closed or all cells to be closed except one. Thus, the control patterns for the tag container are particularly simple in that they cause the opening of at most one cell at a time.

Cell access in the preferred embodiment is accomplished by a purely mechanical process—the rotation (or translation) of the cell access body relative to the cell body. It may be desirable in some cases, where the selection of a control pattern must result in a number of cells being opened rather than just one, to utilize individual covers for the cells, a cover being opened by the application of power to a solenoid or equivalent device, a cover being closed upon the removal of power by a spring return on the armature of the solenoid. The application of power to the solenoids specified by a control pattern would cause the associated covers to open and the other covers to close as a result of the spring action. Such an embodiment would permit control patterns to be defined for a variety of different combinations of open and closed cells.

Figure 7:
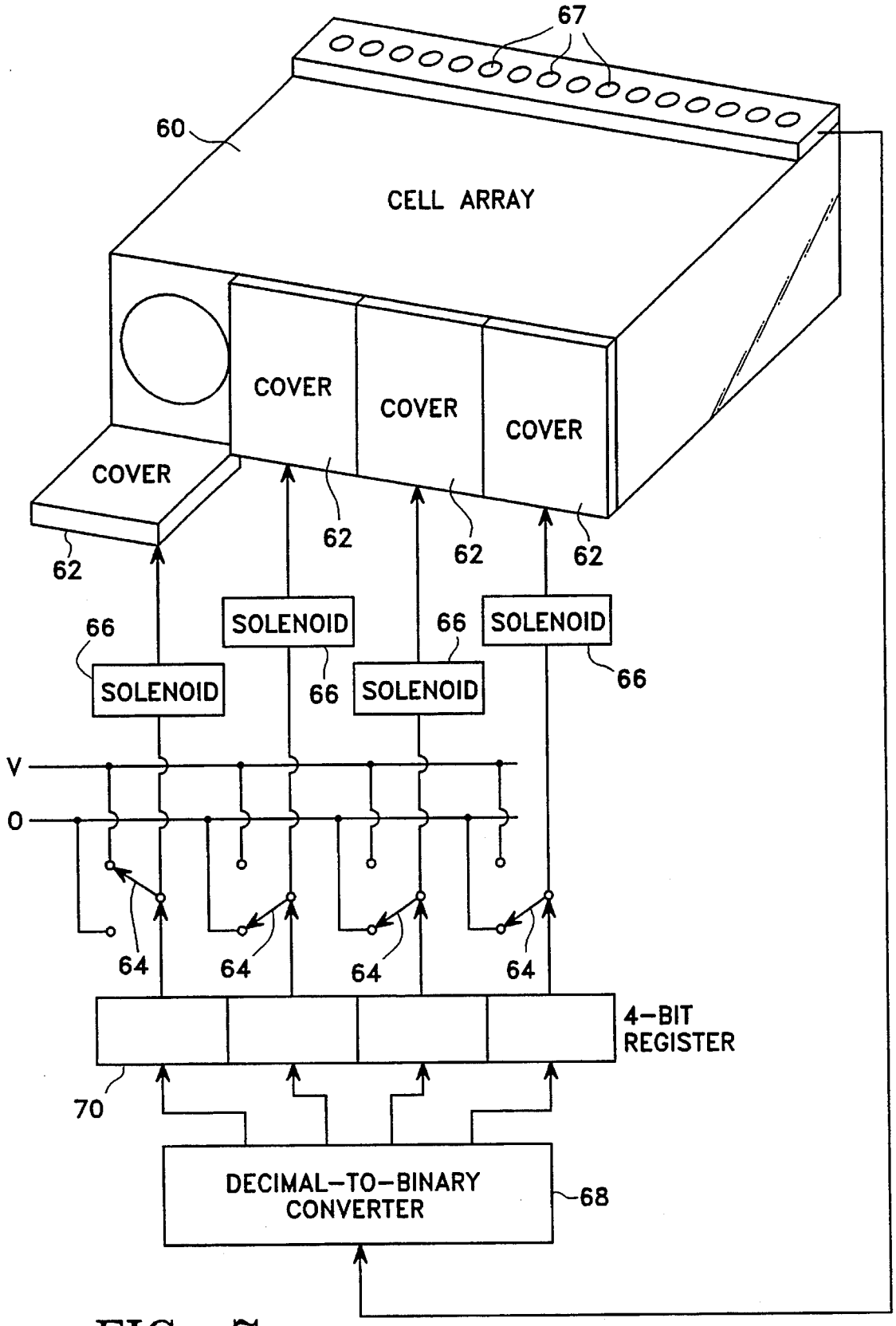
FIG. 7 is a block diagram of an electomechanical embodiment of the invention.

A block diagram of an electromechanical embodiment of the invention is shown in FIG. 7. The container is comprised of a linear array of cells 60 with hinged covers 62. The covers are opened by applying a voltage V through switches 64 to solenoids 66. The covers are closed by the aforementioned spring action when a zero voltage is applied to the solenoids. The available control patterns are represented by activating push buttons 66, one push button for each control pattern. The user selects a control pattern by pushing the appropriate button thereby causing the decimal number associated with the button to be entered into the decimal-to-binary converter which converts the decimal number into its equivalent binary form. The binary equivalent of the input decimal number is entered into a four bit register 70. Each bit in the register controls one of the switches 64. A "one" bit causes a switch to apply the voltage V to a solenoid thereby causing the cover of a cell to open. A "zero" bit causes a switch to apply a zero voltage to a solenoid thereby causing the cover of a cell to close. In this way the container cells are opened and closed in accordance with the bit sequence associated with the selected control pattern.

The preferred embodiment is illustrated by a container designed to store one cylindrical identification tag with a diameter of approximately 2 mm and a length of approximately 14 mm in each cell of the container. The preferred embodiment for storing other types of objects are likely to require different designs and may require more complicated control patterns.

For example, the invention might be used for regularly dispensing medication to senior citizens in care facilities. The multi-cell container for this purpose would have one or more cells for storing each variety of pill, tablet or capsule required by the population of senior citizens in the care facility. For a medication that is prescribed in dosages of one, two, or three pills, one cell would hold one pill, another cell would hold two pills, and a third cell would hold three pills. Each senior citizen requiring medication would be assigned a control pattern which, when selected by the care giver, would cause the designated medications in the appropriate doses to be dispensed by the container. The container used for this purpose would require a replenishing means to restore the appropriate medications to the emptied cells after each dispensing operation.

The invention might also be used in controlling the access of animals kept in cells to a common exercise yard. Control patterns could be defined for compatible groups of animals. The keeper could allow a compatible group of animals to enter the exercise yard from their cells by selecting the appropriate control pattern which would cause the appropriate cell gates to be opened.

The embodiments thus far discussed were directed toward the storage of solid objects. However, the invention is also appropriate for the storage of liquids and gases if cell closures are made liquid- and gas-tight.

Embodiments of the invention may be made from a variety of materials including metals, plastics, ceramics, and semiconductors and by a variety of fabrication techniques including machining, casting, injection molding, and micromachining utilizing integrated circuit fabrication techniques.

If the container is to be exposed to gases or liquids for the purpose of disinfecting or cleaning the stored objects or for some other purpose, care should be used in choosing the material of the container so that undesirable chemical reactions between container and the gases or liquids do not take place.

Typical disinfectants for tags to be implanted in birds and animals are (1) isopropyl alcohol and (2) a mixture of chlorhexidine, acetate, and certain inactive ingredients sold under the trademark "NOVASAN". A typical disinfectant for tags to be implanted in fish is ethanol. A suitable plastic for use with any of these disinfectants is polypropylene.

What is claimed is:

1. A container for storing objects, the container comprising:

a plurality of cells for receiving objects, each of the cells having an ingress/egress side and a side opposite to the ingress/egress side, each of the cells having an opening for object ingress and egress in the ingress/egress side of the cell, the side opposite to the ingress/egress side being continually permeable to gases and liquids; and a means for closing and opening the cells to cell ingress and egress in accordance with a control pattern which specifies the cells that are to be open and the cells that are to be closed.

2. The container of claim 1 wherein the cells are in a cell body and the closing/opening means is a cell access body which abuts the cell body, the cell access body having a continually-open passageway to each cell for gases and liquids to enter and leave the cell.

3. The container of claim 1 wherein the cells are in a cell body and the closing/opening means is a cell access body which abuts the cell body, the cell body having a passageway to each cell for gases and liquids to enter and leave the cell, the entry to each passgeway being from the side of the cell opposite to the ingress/egress side.

4. A container for storing objects, the container comprising:

a plurality of cells for receiving objects, the cells having openings for object ingress and egress; and a means for closing and opening the cells to cell ingress and egress in accordance with a control pattern which specifies the cell that are to be open and the cells that are to be closed, the closing/opening means comprising for each of the cells an electromechanically-controlled cover having states of being closed or being open and input terminals for receiving electrical power, a cover being in one state when the voltage applied to the terminals is greater than a predetermined value and being in the other state when the voltage is less than the predetermined value.

5. A container for storing objects the container comprising:

a plurality of cells for receiving objects, each of the cells having an opening for object ingress and egress on one side of the cell, an object being retrievable from a cell by means of a tool that is separate and distinct from and not apart or the container;

a means for closing and opening the cells to cell ingress and egress in accordance with a control pattern which specifies the cells that are to be open and the cells that are to be closed;

a means by which a user selects one of a plurality of control patterns, the selection causing the closing/opening means to close and open the cells as specified by the selected control pattern;

a means which prevents the tool from touching the side of the cell opposite to the ingress/egress side.

6. The container of claim 5 wherein the tool is comprised of an elongated member with a shoulder, the cells are in a cell body and the closing/opening means is a cell access body which abuts the cell body, the cell access body being movably attached to the cell body, the movement of the cell access body relative to the cell body being the means by which a user selects a control pattern, the cell access body, limiting the penetration of the tool into an open cell by obstructing the shoulder of the tool.

7. The container of claim 6 wherein the cell body and the cell access body have a common axis and mating surfaces having rotational symmetry about the common axis, the surface of the cell access body abutting the surface of the cell body, the cell access body being rotatably attached to the cell body on the common axis thereby allowing rotational motion of the cell access body relative to the cell body about the common axis.

8. A container for storing objects, the container comprising:

a plurality of cells for receiving objects, the cells having openings for object ingress and egress, the cells being in a cell body;

a cell access body for closing and opening the cells to cell ingress and egress in accordance with a control pattern which specifies the cells that are to be open and the cells that are to be closed, the cell body and the cell access body having abutting planar surfaces, the cell access body being translatably attached to the cell body thereby allowing translational motion of the cell access body relative to the cell body parallel to the planar surfaces;

a means by which a user selects one of a plurality of control patterns, the selection causing the closing/opening means to close and open the cells as specified by the selected control pattern, the movement of the cell access body relative to the cell body being the means by which a user selects a control pattern.

9. The container of claim 1 further comprising:

a means by which a user selects one of a plurality of control patterns, the selection causing the closing/opening means to close and open the cells as specified by the selected control pattern the closing/opening means comprising an electromechanically-controlled cover having states of being closed or being open and input terminals for receiving electrical power, a cover being in one state when the voltage applied to the terminals is greater than a predetermined value and being in the other state when the voltage is less than the predetermined value, the pattern control selecting means causing voltages to be applied to the covers whereby the covers are opened and closed in accordance with the selected control pattern.

10. The container of claim 1 further comprising:

an object support means in each cell that causes an object stored in a cell to be in a position displaced from the side of the cell opposite to the ingress/egress side.

11. The container of claim 10 wherein the support means is a pedestal.

12. A container for storing objects wherein an object is removed from the container by means of a tool, the container comprising:

a plurality of cells for receiving objects, each cell having an opening on one side for object ingress and egress, an object being retrievable from a cell by means of a tool that is separate and distinct from and not a part of the container; and an object support means in each cell that causes an object stored in a cell to be in a position displaced from the side of the cell opposite to the ingress/egress side and orientation whereby a user can acquire and remove the object from the cell by means of the tool.

13. The container of claim 12 wherein the support means is a pedestal which permits the tool to enter the cell to a point between the object and the side of the cell opposite to the ingress/egress side.

14. A process for allowing objects selective ingress into and egress out of a plurality of cells, the cells being used to store objects, the process comprising the step:

(i) closing and opening the cells essentially simultaneously in accordance with a control pattern which specifies the cells to be open, the control pattern specifying that either no cells are to be open or that any combination of cells are to be open.

15. The process of claim 14 further comprising the step:

(ii) selecting one of a plurality of control patterns, step (ii) being performed before step (i).

16. The process of claim 14 wherein the ingress of an object into an open cell is accomplished by a user with a tool, the process further comprising the steps:

acquiring an object with the tool;

inserting the object into an open cell by means of the tool; and releasing the object and removing the tool from the cell.

17. The process of claim 14 wherein the egress of an object from an open cell is accomplished by a user with a tool, the process further comprising the steps:

inserting the tool into an open cell;

acquiring the object with the tool; and removing the tool and object from the cell.

18. A process for inserting an object into an open cell of the container of claim 5 by means of a tool, the process comprising the steps:

selecting a control pattern;

acquiring an object with the tool;

inserting the object into an open cell by means of the tool; and releasing the object and removing the tool from the cell.

19. A process for extracting an object from an open cell of the container of claim 5 by means of a tool, the process comprising the steps:

selecting a control pattern;

inserting the too) into an open cell;

acquiring the object with the tool; and removing the tool and object from the cell.

20. A process for inserting an object into an open cell of the container of claim 10 by means of a tool, the process comprising the steps:

selecting a control pattern;

acquiring an object with the tool;

inserting the object into an open cell by means of the tool; and releasing the object and removing the tool from the cell.

21. A process for extracting an object from an open cell of the container of claim 10 by means of a tool, the process comprising the steps:

selecting a control pattern;

inserting the tool into an open cell;

acquiring the object with the tool; and removing the tool and object from the cell.

* * * * *